United States Patent [19]

Robinson

[11] 4,279,357

[45] Jul. 21, 1981

[54] GARBAGE CAN ASSEMBLY WITH LID ANCHORING MEANS

[76] Inventor: William W. Robinson, 2237 Cambridge Blvd., Columbus, Ohio 43221

[21] Appl. No.: 130,571

[22] Filed: Mar. 14, 1980

[51] Int. Cl.[3] ..... B65D 45/00

[52] U.S. Cl. ..... 220/318; 220/1 T; 220/85 CH; 220/375; 220/379; 150/0.5

[58] Field of Search ..... 220/1 T, 318, 375, 379, 220/85 CH; 150/0.5

[56] References Cited

U.S. PATENT DOCUMENTS

| | | | |
|---|---|---|---|
| 3,503,535 | 3/1970 | Sparks | 220/85 CH |
| 3,817,563 | 6/1974 | McGlothlin | 220/318 X |
| 4,127,211 | 11/1978 | Zerbey | 220/375 X |

*Primary Examiner*—George T. Hall

[57] ABSTRACT

An improved garbage can assembly having a tab lock means for anchoring the garbage can lid to the garbage can handle is disclosed herein. Basically, the improved garbage can assembly comprises a receptacle having a mouth, a lid having a flange which is complementary to and engageable around the mouth of the receptacle, and at least one handle pivotally mounted on the side wall of the receptacle adjacent to the mouth for both securing the lid over the mouth of the receptacle, and providing a closed loop structure for forming a hand grip. A tab lock means integrally connected to the lid is inserted into the closed loop of the handle and serves to anchor the lid to the receptacle whenever the lid is not engaged to the mouth of the receptacle.

8 Claims, 3 Drawing Figures

GARBAGE CAN ASSEMBLY WITH LID ANCHORING MEANS

DESCRIPTION OF THE PRIOR ART

This invention relates generally to improved garbage can assemblies having means to anchor the lid onto the receptacle of the assembly.

A common flaw of many prior art garbage can assemblies is the susceptibility of the lid to become separated from the receptacle, whether by scavaging animals or by the wind. In either case, the wind is capable of furthering this separation so that the lid becomes permanently lost, thereby necessitating the purchase of a replacement lid with all the attendant inconveniences in time and money. This phenomenon is particularly common among the newer plastic garbage can assemblies where the light weight of the plastic lid renders it particularly prone to such wind caused separation. Although many of these plastic garbage can assemblies have a pair of opposing lid locking handles which may be used to lock the lid over the mouth of the receptacle when pivoted upward, this design does not solve the problem of wind separation since garbage collectors often fail to re-lock the lids after emptying the contents. Thus, there is clearly a need for an improved means to anchor lids to receptacles in garbage can assemblies in general, and in molded plastic garbage can assemblies in particular.

Ideally, a lid anchoring means should securely anchor the lid to the receptacle without interfering with either the easy disengagement of the lid from the mouth of the receptacle, or the filling or dumping of refuse from the can by trash collectors or anyone else. Moreover, it would be advantageous if such a lid anchoring means could be easily and inexpensively fabricated as an integral part of the lid of the garbage can assembly. Finally, it would be desirable if such a lid anchoring means could be easily and conveniently installed onto a variety of prior art garbage receptacles without the use of special tools.

None of the lid anchoring means disclosed in the prior art completely fulfills all these criteria. For example, the installation of the garbage can cover retainer disclosed in U.S. Pat. No. 3,980,202 requires screwing and unscrewing at least one set screw in order to open and close the hinge plate attachments of this device. Further, this lid anchoring means is not integrally formed as part of the lid and thus requires manufacturing effort separate from the manufacture of the lid itself.

Likewise, the garbage can lid anchoring attachment disclosed in U.S. Pat. No. 3,503,535 requires installation of a special bracket on the side wall of the receptacle before it can be used. Moreover, it, too, is a separate, rather than integral part of the garbage can assembly and therefore requires a separate manufacturing effort to fabricate.

While the adjustable garbage can cover disclosed in U.S. Pat. No. 4,043,638 discloses a flexible connecting means which apparently may be tied onto the handle of the receptacle, this connecting means is again not integrally formed with the lid of the receptacle, and thus requires a separate and discrete manufacturing effort in order to be fabricated. Further, this reference does not disclose the use of this flexible connecting means on any sort of prior art lids, but only on a lid having an elastic band around its lower periphery which could cause flexible, plastic walled receptacles to buckle or collapse when this special lid is engaged over the mouths of such receptacles.

Finally, while the garbage can lid retainers disclosed in U.S. Pat. Nos. 4,009,897 and 3,358,874 would serve to securely anchor a lid over the mouth of its corresponding receptacle, it is apparent that they would also inherently impede the disengagement of the lid from the receptacle.

Clearly, the prior art has not succeeded in developing a garbage can assembly having an anchoring means for its lid which completely fulfills all of the aforementioned criteria.

SUMMARY OF THE INVENTION

Basically, the invention concerns a garbage can assembly which fulfills all of the aforementioned ideal criteria. The garbage can assembly of the invention generally comprises a receptacle having a mouth, a lid, at least one handle having a closed loop structure which is pivotally mounted on a side wall of the receptacle adjacent to the mouth, and a tab lock means integrally connected to the lid and receivable into the closed loop of the handle for anchoring the lid to the handle whenever the lid is not engaged over the mouth of the receptacle.

The tab lock means of the improved garbage can assembly includes a tab portion which is no wider than the maximum width across the closed loop structure of the handle, as well as a lock portion which is wider than the maximum distance across the closed loop. Preferably, the tab lock means is formed from a flexible, resilient sheet material, so that the lock portion of the tab may be conveniently engaged to the handle of the receptacle by manually contracting it and inserting it through the closed loop structure of the handle and allowing it to expand back to its normal width.

Finally, the tab lock means preferably further includes a bead of reinforcing material around the connection between the tab portion and the tab lock means, as well as an aperture for effecting the display of the lid by hanging on a peg hook at the point of sale.

BRIEF DESCRIPTION OF THE SEVERAL DRAWINGS

DETAILED DESCRIPTION OF THE PREFERRED EMBODIMENT

With reference to the Figures, wherein like number represent like parts of the invention, the preferred embodiment of the invention generally comprises a receptacle 1 having a mouth 2 which may be covered by a lid 3.

Figure 2:
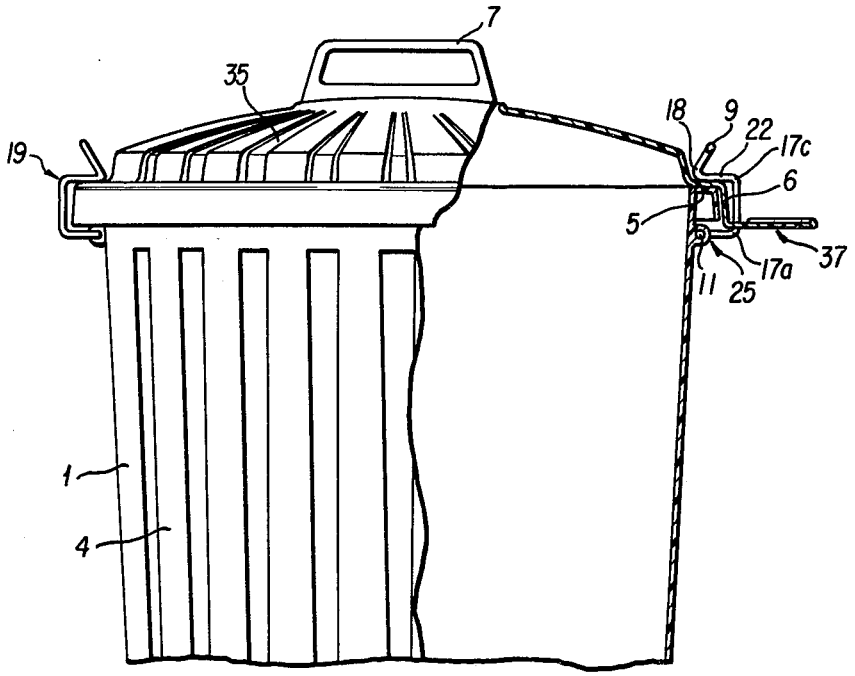
FIG. 2 is a side view of the improved garbage can assembly of the invention.
Figure 3:
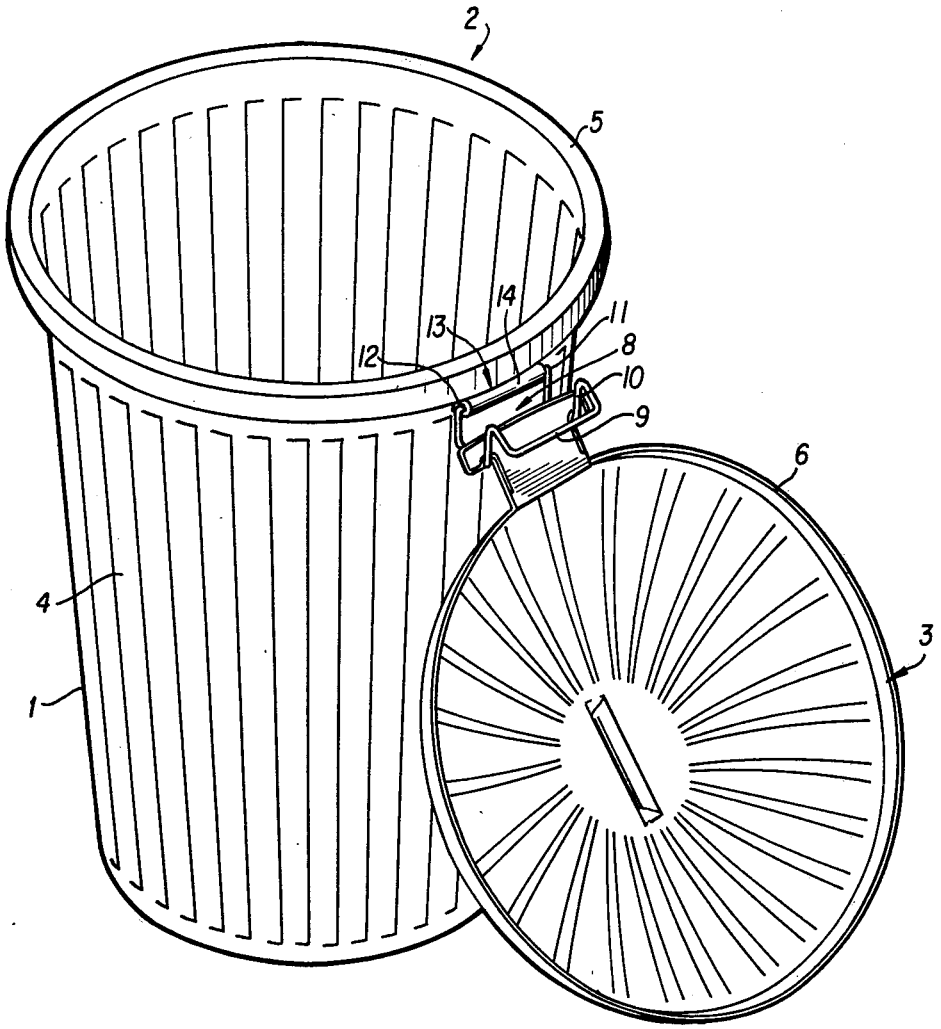
FIG. 3 is a perspective view of the improved garbage can assembly of the invention illustrating how the tab lock means secures the lid when the lid is disengaged from the mouth of the receptacle.

With specific reference to FIGS. 2 and 3, the receptacle 1 of the preferred embodiment is formed out of a resilient, moldable plastic material such as polyethylene and includes a plurality of elongated corrugations 4 for strengthening the walls of the receptacle 1. The mouth 2 of the receptacle 1 is defined by the edge 5 of an annular flange 6 which circumscribes the top of the receptacle 1.

With specific reference to FIG. 2, the receptacle 1 preferably includes two opposing handles 7, 19 which are mounted on pivotal mounting means 13, 25 respectively. The legs of handles 7, 19 each include a pair of right angle bends at 17*a*, 17*b* and 17*c*, 17*d*, respectively, and an acute angle bend at 18*a*, 18*b* to form both a handle portion 9, 21 as well as a lid locking portion 10, 22 which secures the lid 3 in the manner shown. Each of the pivotal mounting means 13, 25 are located adjacent to the edge 5 of the mouth 2 of the receptacle 1 so that the lid locking portions 10, 22 of the handles 7, 19 may properly operate.

With specific reference to FIG. 3, handle 7 is preferably fabricated from a generally "U" shaped piece of heavy guage wire which is typically three sixteenths to a quarter inch in diameter. The ends of the legs of the "U" shaped piece of wire include two mutually opposing prongs 11, 12. The pivotal mounting 13 includes a lug 14 having a lug bore 15 for receiving the mutually opposing prongs 11, 12 of of the handle 7. When the handle prongs 11, 12 are journaled in the lug bore 15 as shown, the handle 7 in combination with the lug 14 of the pivotal mounting 13 forms a closed loop structure generally indicated at 8Handle 19 is identical in all respects to handle 7 and likewise forms a closed loop 20 (not shown) along with lug 26 of the pivotal mounting 25.

Figure 1:
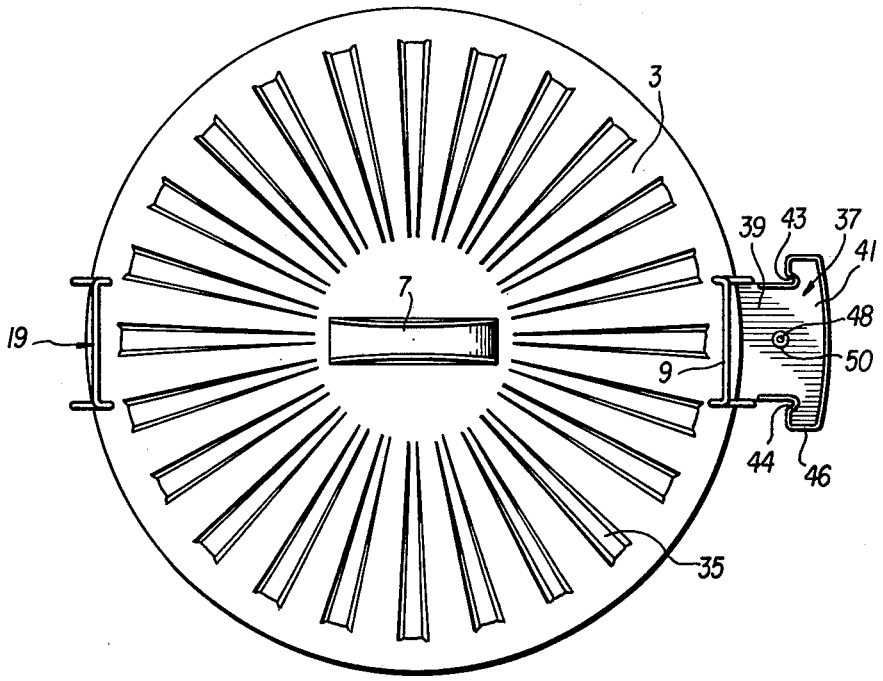
FIG. 1 is a plan, elevational view of the lid of the improved garbage can assembly which illustrates the integrally formed tab lock means of the invention.

With reference to FIG. 1, lid 3, like receptacle 1, is also formed from a moldable, resilient plastic material such as polyethylene. Lid 3 includes a centrally located handle 31, and is circumscribed by an annular flange 33 which is complementary to and engagable around the annular flange 6 which forms the edge 5 of the mouth 2 of the receptacle 1. Lid 3 also preferably includes a plurality of radial corrugations 35 which serve to strengthen and regidify it. Finally, lid 3 includes a tab lock 37 for anchoring the lid 3 to the receptacle 1 when the lid 3 is disengaged from the mouth 2 of the receptacle 1.

With reference to FIGS. 1 and 3, tab lock 37 includes both a tab portion 39, as well as a lock portion 41. Tab portion 39 is no wider than the maximum width of closed loop 8 of the handle 7, while lock portion 41 is wider than the maximum width of closed loop 8. Tab lock 37 further includes a pair of recesses 43, 44 at the junction between the tab portion 39 and lock portion 41. Preferably, tab portion 39 is about as wide as the minimum distance between the two parallel legs of the handle 7 so that the recesses 43, 44 may receive the legs of handle 7 in the vicinity of right angle bends 17*c* when the lid 3 is disengaged from the mouth 2 of the receptacle 1, as illustrated in FIG. 3. These recesses 43, 44 are preferably complementary in shape to the cross sectional shape of the "U" shaped piece of wire forming the handles in order to minimize tearing forces exerted by the handle legs in these areas of tab lock 37. Further, these recesses are reinforced by a peripheral bead 46 to further discourage tearing of the tab lock 37 at the junction between the tab lock 37 and the portion 39 by the legs of handle 7. Finally, tab lock 37 includes an aperture 48 for receiving the prong of a peg hook to hang the lid for display. Aperture 48 is also preferably reinforced by a peripheral bead 50 which entirely circumscribes it.

In operation, lock portion 41 is manually folded along its width and passed through the closed loop 8 of the handle 7 and allowed to expand back to its normal dimensions. When lid 3 is disengaged from receptacle 1 incident to dumping or filling, recesses 43, 44 seat themselves on the legs of handle 7 in the vicinity of the right angle bends 17*d* as shown in FIG. 3. The tab lock 37 serves to securely anchor the lid 3 onto the receptacle 1 without interfering with the normal use of the can.

Having claimed my invention in such full, clear and concise terms so as to allow a person of ordinary skill in the art to make and use the same, I claim:

1. An improved garbage can assembly, comprising:

(a) a receptacle having an edge defining a mouth;

(b) a lid having a flange which is complementary to and engageable around said edge for covering said mouth;

(c) at least one handle pivotally mounted on a side wall of said receptacle adjacent to said edge, said handle having both a lid locking means for locking said lid over said mouth, and a closed loop structure for forming a hand grip, and (d) a tab lock means connected to said lid and receivable into said closed loop of said handle for anchoring said lid to said handle when said lid flange is not engaged to said receptacle edge.

2. The improved garbage can assembly of claim 1 wherein said tab lock means includes a tab portion which is narrower than the maximum distance across said closed loop of said handle, and a lock portion which is wider than said maximum distance across said closed loop, whereby said lid is connected to said handle by inserting said lock portion through said closed loop of said handle.

3. The improved garbage can assembly of claim 2 wherein said lock portion of said tab lock means is formed from a flexible resilient sheet material whereby said lid is connected to said handle by manually contracting said lock portion of said tab lock means along its width, inserting it through said closed loop of said handle and allowing it to expand back to its normal width.

4. The improved garbage can assembly of claim 3 wherein said lid is formed from a flexible, resilient sheet material, and said tab lock means is integrally connected with said flange.

5. The improved garbage can assembly of claim 4 wherein said lock portion and said tab portion of said tab lock means are integrally connected, wherein said tab lock means further includes a bead of reinforcing material extending around the integral connection between said tab portion and said tab lock means.

6. The improved garbage can assembly of claim 5 wherein said lock portion of said tab lock means includes an aperture for effecting the display of the lid by hanging on a peg hook at the point of sale.

7. A garbage can assembly of the type including a receptacle having an edge defining a mouth, a lid having a flange which is complementary to and engageable around said edge for covering said mouth; at least one handle pivotally mounted on a side wall of said receptacle adjacent to said edge, and said handle having both a lid locking means for locking said lid over said open end, and a closed loop structure for forming a hand grip; the improvement of which comprises a tab lock means connected to said lid and receivable into said closed loop of said handle for anchoring said lid to said handle when said lid flange is not engaged to said receptacle edge.

8. The garbage can assembly of claim 7 wherein said tab lock means includes a tab portion which is narrower than the maximum distance across said closed loop of said handle, and a lock portion which is wider than said maximum distance across said closed loop, whereby said lid is connected to said handle by inserting said lock portion through said closed loop of said handle.

* * * * *